United States Patent [19]

Brühwiler et al.

[11] Patent Number: 4,967,561

[45] Date of Patent: Nov. 6, 1990

[54] COMBUSTION CHAMBER OF A GAS TURBINE AND METHOD OF OPERATING IT

[75] Inventors: Eduard Brühwiler, Turgi; Hans Koch, Zürich, both of Switzerland; Gerald Roffe, East Northport, N.Y.

[73] Assignee: ASEA Brown Boveri AG, Baden, Switzerland

[21] Appl. No.: 428,414

[22] Filed: Nov. 6, 1990

Related U.S. Application Data

[63] Continuation of Ser. No. 371,699, Jun. 23, 1989, abandoned, which is a continuation of Ser. No. 714,436, Mar. 21, 1985, abandoned, which is a continuation of Ser. No. 497,418, May 24, 1983, abandoned.

[30] Foreign Application Priority Data

May 28, 1982 [CH] Switzerland ..... 3295/82

[51] Int. Cl.[5] ..... F02C 7/22

[52] U.S. Cl. ..... 60/737; 60/746; 60/748; 60/751; 60/39.463; 60/39.465

[58] Field of Search ..... 60/39.463, 39.465, 737, 60/746, 748, 751, 39.141, 742

[56] References Cited

U.S. PATENT DOCUMENTS

| | | | |
|---|---|---|---|
| 2,850,875 | 9/1958 | Gähwyler | 60/746 |
| 3,236,279 | 2/1966 | Beyer | 60/746 X |
| 3,630,024 | 12/1971 | Hopkins | 60/748 X |
| 3,691,765 | 9/1972 | Carlisle | 60/742 |
| 3,777,983 | 12/1973 | Hibbins | 60/742 |
| 3,886,728 | 6/1975 | Quinn | 60/737 |
| 3,904,119 | 9/1975 | Watkins | 60/737 X |
| 4,100,733 | 7/1978 | Striebel et al. | 60/737 X |
| 4,107,918 | 8/1978 | Andrew et al. | 60/746 X |
| 4,134,719 | 1/1979 | Velie . | |
| 4,288,980 | 9/1981 | Ernst . | |
| 4,327,547 | 5/1982 | Hughes et al. | 60/39.463 |
| 4,356,698 | 11/1982 | Chamberlain . | |
| 4,408,461 | 10/1983 | Brühwiler et al. | 60/737 |

FOREIGN PATENT DOCUMENTS

| | | | |
|---|---|---|---|
| 30133 | 11/1980 | European Pat. Off. . | |
| 29619 | 6/1981 | European Pat. Off. | 60/737 |
| 1074920 | 2/1970 | Fed. Rep. of Germany . | |
| 305532 | 6/1952 | Switzerland . | |
| 721126 | 12/1954 | United Kingdom . | |
| 1543032 | 1/1978 | United Kingdom . | |

*Primary Examiner*—Donald E. Stout

*Attorney, Agent, or Firm*—Burns, Doane, Swecker & Mathis

[57] ABSTRACT

In the combustion chamber of a gas turbine, an air distribution chamber (19) and a combustion space (7) are locationally separated from one another within the combustion chamber shell (1). A multiplicity of tubular elements (2) are located between the distibution chamber and the combustion space, in which elements a premixing and pre-evaporation of the fuel oil supplied via the premixing nozzles (15') and/or a premixing of the fuel gas supplied through the premixing nozzles (15'') takes place with compressor air. Each tubular element (2) is provided with a flameholder (3) in the direction towards the combustion space (7). A diffusion nozzle (8) for fuel directed into the combustion space (7) is located within the flameholder. In operation on load, only a small part of the fuel supplied to each element (2) is burned by means of the diffusion nozzle (8), the major proportion, on the other hand, being burnt by means of the premixing nozzles (15' of 15'').

6 Claims, 6 Drawing Sheets

COMBUSTION CHAMBER OF A GAS TURBINE AND METHOD OF OPERATING IT

This application is a continuation of application Serial No. 371,699 filed June 23, 1989, now abandoned, which is a continuation of application Serial No. 714,436 filed Mar. 21, 1985, now abandoned, which is a continuation of application Serial No. 497,418 filed 5/24/83, now abandoned.

BACKGROUND OF THE INVENTION

Gas turbines are increasingly subject to the strict environmental protection regulations of many countries with regard to exhaust gas composition. In operating a gas turbine, the maintenance of the regulations on the maximum permitted $NO_x$ emissions, more than anything else, causes great difficulties. Thus there are currently legal regulations in force, namely in the U.S.A., whereby the $NO_x$ emissions content may not exceed 75 ppm at 15 vol. % $O_2$. Similar regulations have to be observed in most industrial states and it is rather to be expected that the permissible figures will in future be corrected in a downwards direction. Up to now, these requirements could only be maintained by the use of large injections of water or steam into the combustion space. The means used for the reduction of the emission figures, i.e. water or steam, do, however, introduce some important disadvantages.

If water is injected into the combustion space, a loss of efficiency is to be expected. In addition, water is not always and everywhere available in sufficient quantities, for example in low precipitation countries. The water must also be subjected to a preparation process before its use because many minerals appearing in the water, for example sodium, common salt, etc., have a strongly corrosive effect on their environment. This preparation process is, in this context, costly and energy intensive. If, on the other hand, steam is introduced to the combustion space, the loss in efficiency mentioned above is thus avoided. The steam generation, however, also presupposes water and its preparation is not less energy intensive.

A combustion chamber of the type mentioned above without water or steam injection is known from German Application 2,950,535 which corresponds to European Patent Application No. 29619. Due to the fact that a premixing/preevaporation process takes place between the injected fuel and the compressor air at a large excess air coefficient and within a number of tubular elements before the actual combustion process takes place downstream of a flame holder, the emission figures of pollutants from the combustion can be substantially reduced. The combustion with the greatest possible excess air coefficient—fixed on the one hand by the flame continuing to burn at all and, on the other, by not too much CO occurring—reduces, however, not only the pollutant quantity of $NO_x$ but also effects a consistent restriction of other pollutants, namely, as already mentioned, of CO and of unburned hydrocarbons, to low levels. This optimisation process can, with the known combustion chamber, be forced in the direction of still lower $NO_x$ values by keeping the space for combustion and subsequent reactions much longer than would be necessary for the actual combustion. This permits the choice of a larger excess air coefficient, with, in fact, larger quantities of CO occurring initially but these can further react to $CO_2$ so that the CO emissions finally remain small. On the other hand, however, only a small amount of additional NO forms because of the large air excess. Since several tubular elements undertake the premixing/pre-evaporation, only enough elements are operated with fuel in the load control operation in each case so that the optimum excess air coefficient is obtained for the current operating phase (start-up, part load, etc.).

Now such a type of combustion chamber has, however, the shortcoming that, particularly at part load, i.e. when only a part of the elements are in operation with fuel, the limit of flame stability is met because the extinguishing limit is attained, even at an excess air coefficient of approximately 2.0, because of the very weak mixture and the resulting low flame temperature.

Summary of the Invention

In view of these difficulties with the known type of combustion chamber, it is an object of the invention, to raise the stability limit of a combustion chamber of the type mentioned above over the whole operating range by design means in such a way that extinguishing of the flame can be avoided with certainty.

The advantage of the invention is to be seen mainly in the fact that a means is provided of keeping the combustion within the ignition limits at all times in a relatively simple manner by appropriate distribution of the fuel to the premixing or diffusion nozzles. An additional and particularly favourable effect is that the use of the previous pilot burner can be omitted.

If the combustion chamber is operated according to a particular fuel control curve, and if, in addition, the successive ignition of the burners occurs from the inside outwards, then in addition to the required flame stability, a combustion is present with which the CO emissions have much better values than are obtained, for example, with the combustion chamber mentioned at the beginning.

Description of the Drawings

A preferred embodiment of the invention is shown schematically in the drawings, in which.

Description of the Preferred Embodiment

All the elements not necessary for direct understanding of the invention, such, for example, as the location and arrangement of the combustion chamber on the rotating machine, the fuel preparation, the control devices and similar are omitted. The flow directions of the various working media are indicated by arrows. In the various figures, the same elements in each case are provided with the same reference signs.

Figure 1:
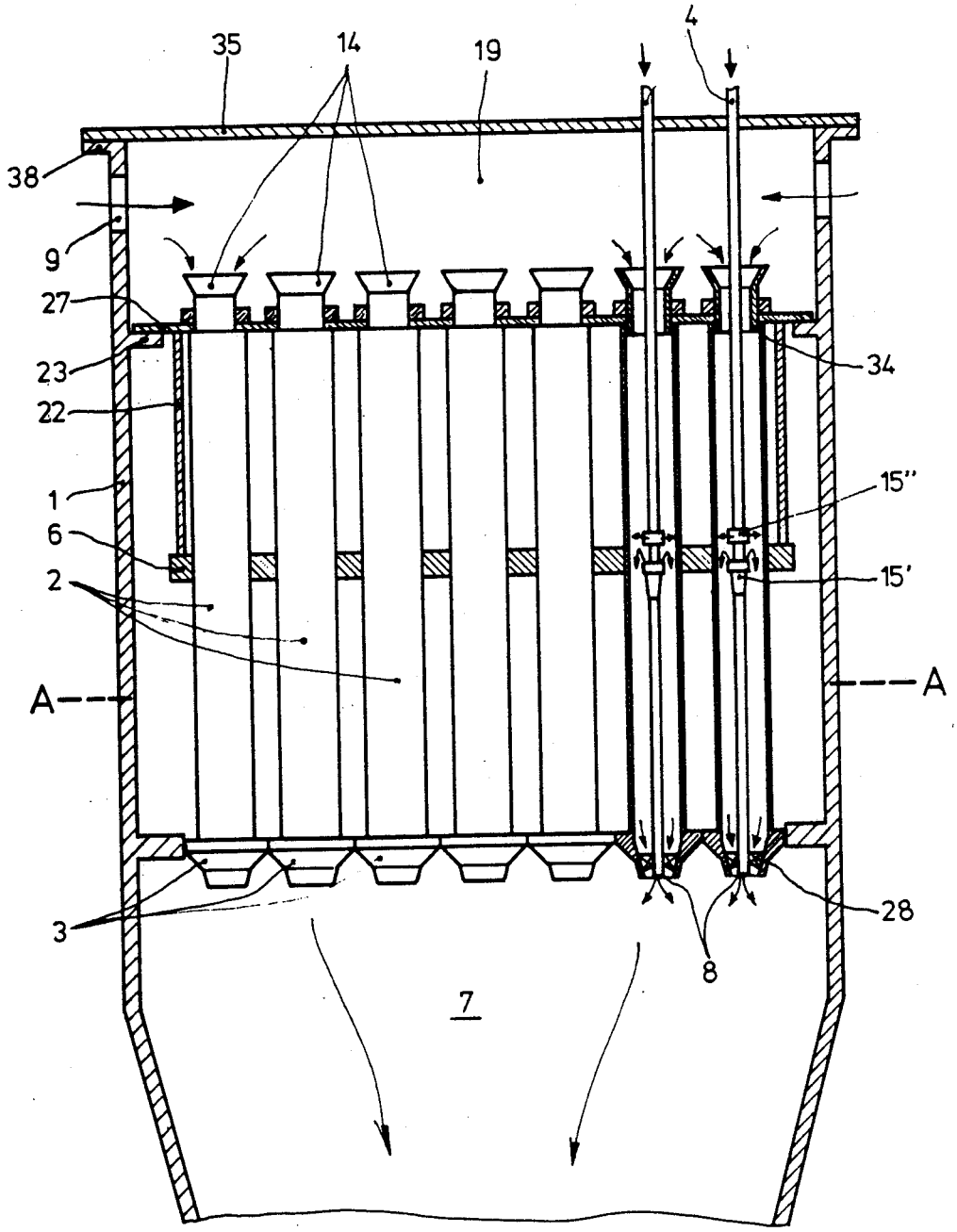
FIG. 1 is a longitudinal cross-sectional view of a combustion chamber in accordance with this invention
Figure 2:
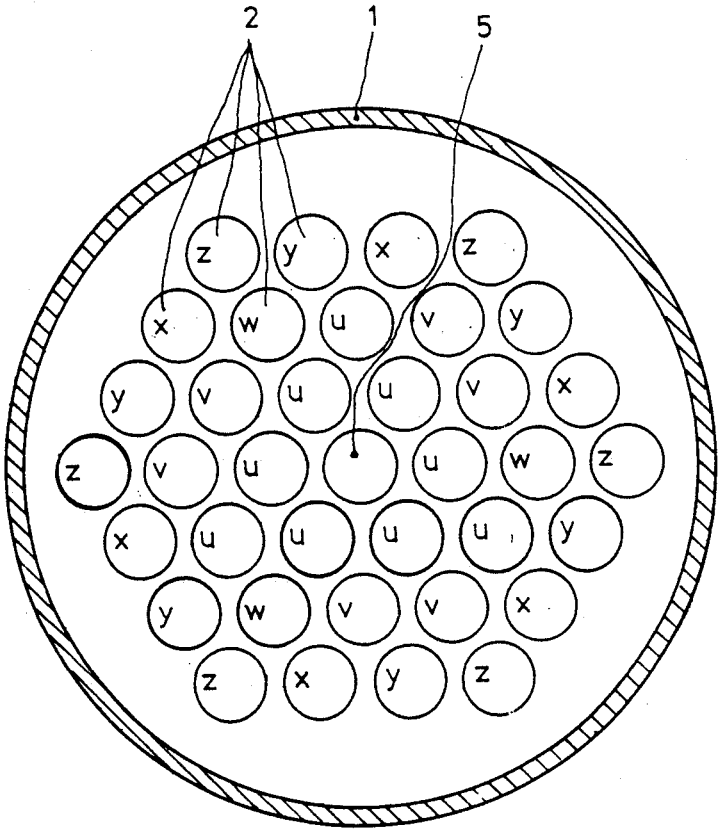
FIG. 2 is a cross-sectional view of the combustion chamber along the line A—A in FIG. 1.

FIG. 1 shows, in a greatly simplified manner, the concept of a combustion chamber with the fuel supply according to the invention. In the upper region of the combustion chamber shell 1 are located a rather large number of tubular elements 2, which optimally fill the available space. An example of such an arrangement is seen in FIG. 2, in which 36 tubular elements 2 are located around a central ignition burner 5. The number is not, however, imperative because it depends on the size of the combustion chamber, which in turn depends on the desired combustion performance. A supporting bridge 27, with which the tubular elements 2 are connected using suitable means, is locationally fixed to a supporting rib 23. The tubular elements 2 are laterally guided approximately in the middle of their longitudinal extension by means of a guide plate 6. Several support elements 22, which are in turn solidly connected with the supporting bridge 27, carry the guide plate 6. The tubular elements 2 can, of course, be locationally fixed otherwise than by means of the supporting bridge 27 shown; in such cases, it will, however, always be necessary to ensure that the locational fixing selected is placed as far as possible from the combustion space 7 so that the thermal expansions cannot induce a deleterious effect.

The larger part of the compressed air quantity, which is provided by the compressor (not shown), flows through the openings 9 into a distribution chamber 19 provided in the combustion chamber shell, which distribution chamber is bounded in the downwards direction by the supporting bridge 27 and in the upwards direction by the cover 35 flanged from the flange rib 38. The compressed air then flows from this distribution chamber 19 through the air funnel 14 into the individual tubular elements 2. The fuel supply for each tubular element 2 is provided by a fuel pipe 4, a fuel nozzle 15', protruding into the annular element 2, dealing with the atomisation of the oil and a fuel nozzle 15" dealing with the blowing in of the gas. The fuel mixes with the inflowing compressed air in such a way that a premixing/pre-evaporation process takes place in the tubular element 2. This process is intensified by the use of a Borda mouthpiece 34 at the air inlet of the tubular element 2 because of the turbulence thus arising. In such a case, the fuel injection or blowing in of the fuel through the fuel nozzles 15' and 15" respectively must take place at a optimum distance from the Borda mouthpiece 34 but still within the region of the turbulence arising.

During the time in which the fuel and the combustion air flows through the tubular element 2 as far as the outlet of a flameholder 3, the fuel evaporates and mixes with the air. The degree of evaporation becomes greater with increasing temperature and residence time and decreasing droplet size of the atomised fuel. With increasing temperature and pressure, however, the critical time period to self-ignition of the mixture reduces, so that the length of the tubular element 2 is adjusted so that the best possible evaporation occurs during the shortest possible time. In the case of gas, the evaporation is unnecessary; it is only necessary to mix the gas evenly with the air.

The flameholder 3, which forms the end of the downstream located part of the tubular element 2, has the task of preventing burn-back of the flame from the combustion space 7 into the inside of the tubular element 2. It is preferably provided with a swirler 28, the mixture being guided swirling through its openings to the combustion space 7. The swirler 28 helps ensure a stable flame and a good heat distribution by means of the return flow occurring downstream in the center of the flame, whence a homogeneous temperature and velocity distribution results after the combustion space 7 with the effect that the turbine, which is not shown, is evenly loaded.

In accordance with the invention, a diffusion nozzle 8 is now located within the flameholder 3 of each element 2 and this diffusion nozzle injects the fuel directly into the combustion space 7. This nozzle 8 is intended for both oil operation and gas operation. It is so designed that running up with oil operation can be exclusively undertaken using diffusion combustion, i.e. it can deal with the complete oil quantity supplied to an element 2. Because of the different volume relationships in gas operation, it is only possible to deal there with approximately 50% of the total gas quantity supplied to an element 2 if the flow cross-section of the nozzle 8 remains unaltered.

Figure 3:
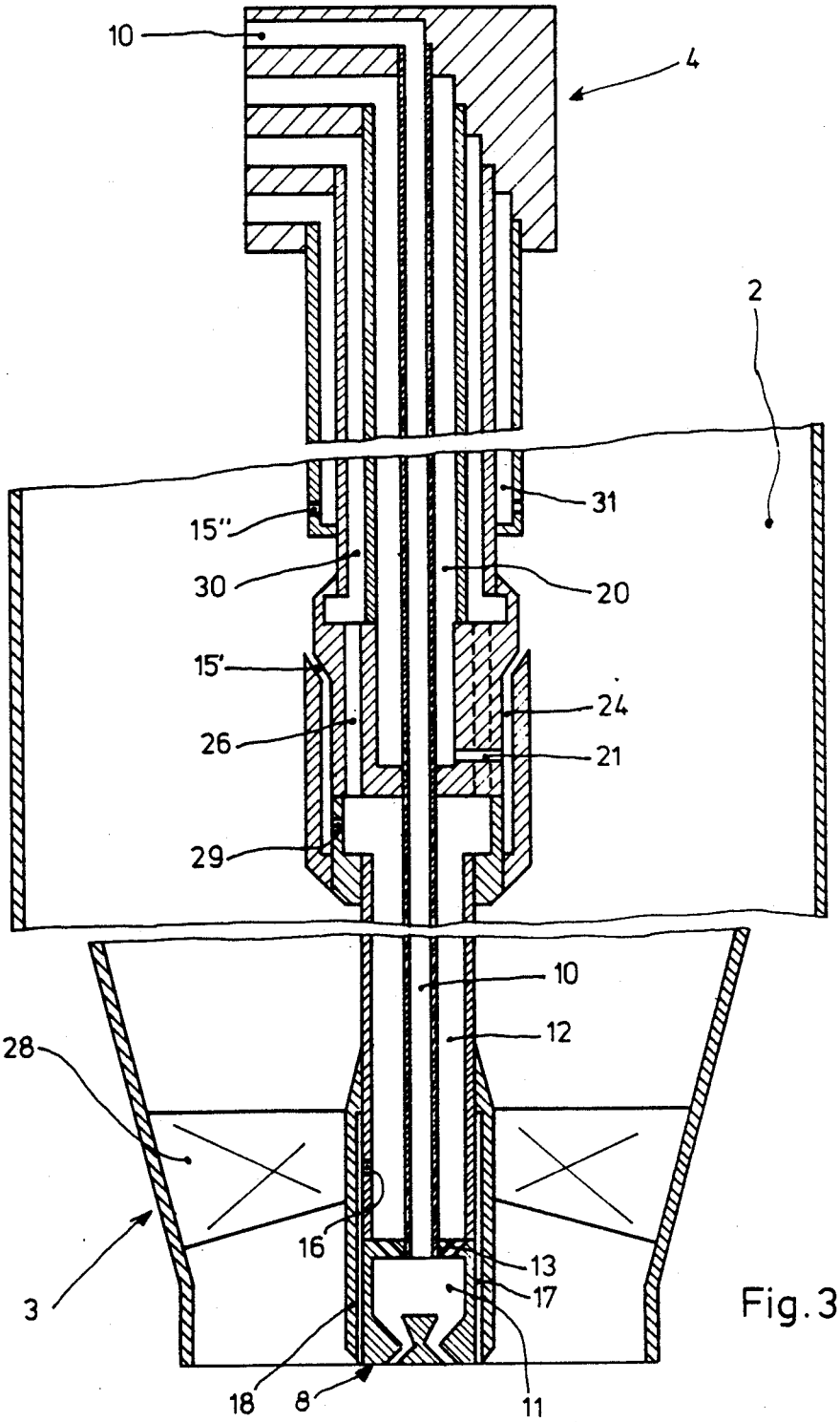
FIG. 3 is an enlarged cross-sectional view of the system for fuel supply.

A simplified diagram of the principle of the fuel supply is shown in FIG. 3. The fuel (oil or gas depending on the type of operation) is supplied to a swirl chamber 11 via a central pipe 10. The atomisation air is supplied to an annular space 12 surrounding the central pipe 10 and enters the chamber 11 via openings 13. The mixture is injected into the combustion space 7 via a conventional diffusion nozzle 8. The diffusion nozzle is cooled by an air stream which is extracted from the annular space 12 upstream of the swirl chamber 11 via a hole 16 and supplied to an annular chamber 17, which is bounded towards the outside by a shell 18. The swirlers 28 of the flameholder 3 are attached to this shell 18.

Separate fuel nozzles 15' and 15" respectively are provided for each of the premixing systems for oil and gas operation located approximately at half height of the elements 2. The decisive point in this connection is that the oil should preferably be introduced against the inlet airflow direction and the gas, on the other hand, in or transverse to the air direction in the mixing space.

An annular supply line 20 for the fuel oil is located around the central pipe 10 in the region of the premixing system and this communicates with an outlet chamber 24 via a hole 21 at approximately half chamber height. For design reasons, the atomisation air is carried in this region in longitudinal holes 26 evenly distributed around the periphery and emerging at their lower ends into the annular space 12 already mentioned. At its upper end, this annular space 12 communicates with the lower closed end of the outlet chamber 24 via a hole 29. The outlet chamber 24 is provided at its upper end with an annular nozzle 15', via which the mixture is injected against the combustion air into the actual mixing and evaporation space. The choice of a suitable injection angle for this purpose is of decisive importance for the amount of premixing and also for ensuring that no oil which has not been turned into a mist reaches the wall of the element 2. It is obvious that the publication of absolute values must be omitted here because these are dependent on all too numerous thermodynamic and geometric parameters and have no conclusive value without knowledge of them.

The gas premixing system is located above the oil premixing system. The atomisation air not required in this region is here again supplied to an annular chamber 30 concentrically surrounding the ducts 12 and 20. This annular chamber 30 is enclosed on the outside by a gas chamber 31, from which the combustion gas is blown under pressure via the nozzles 15" into the mixing space, this occurring at right angles to the flow direction of the combustion air.

The nozzles 15' and 15" are so dimensioned that they can deal with the total fuel quantity supplied to an element 2.

Figure 4:
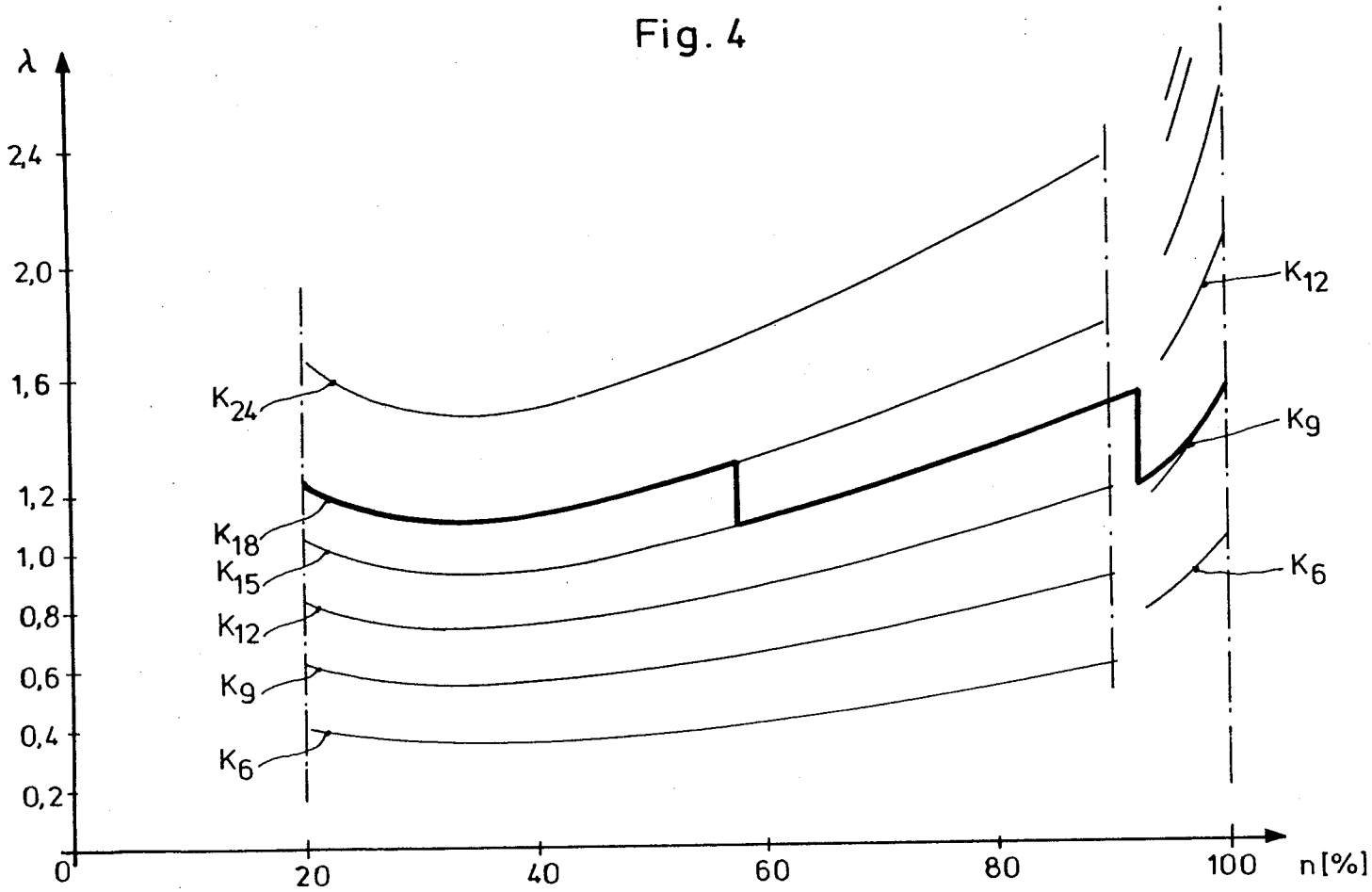
FIG. 4 shows a fuel control curve for running up the combustion chamber in oil operation.
Figure 5:
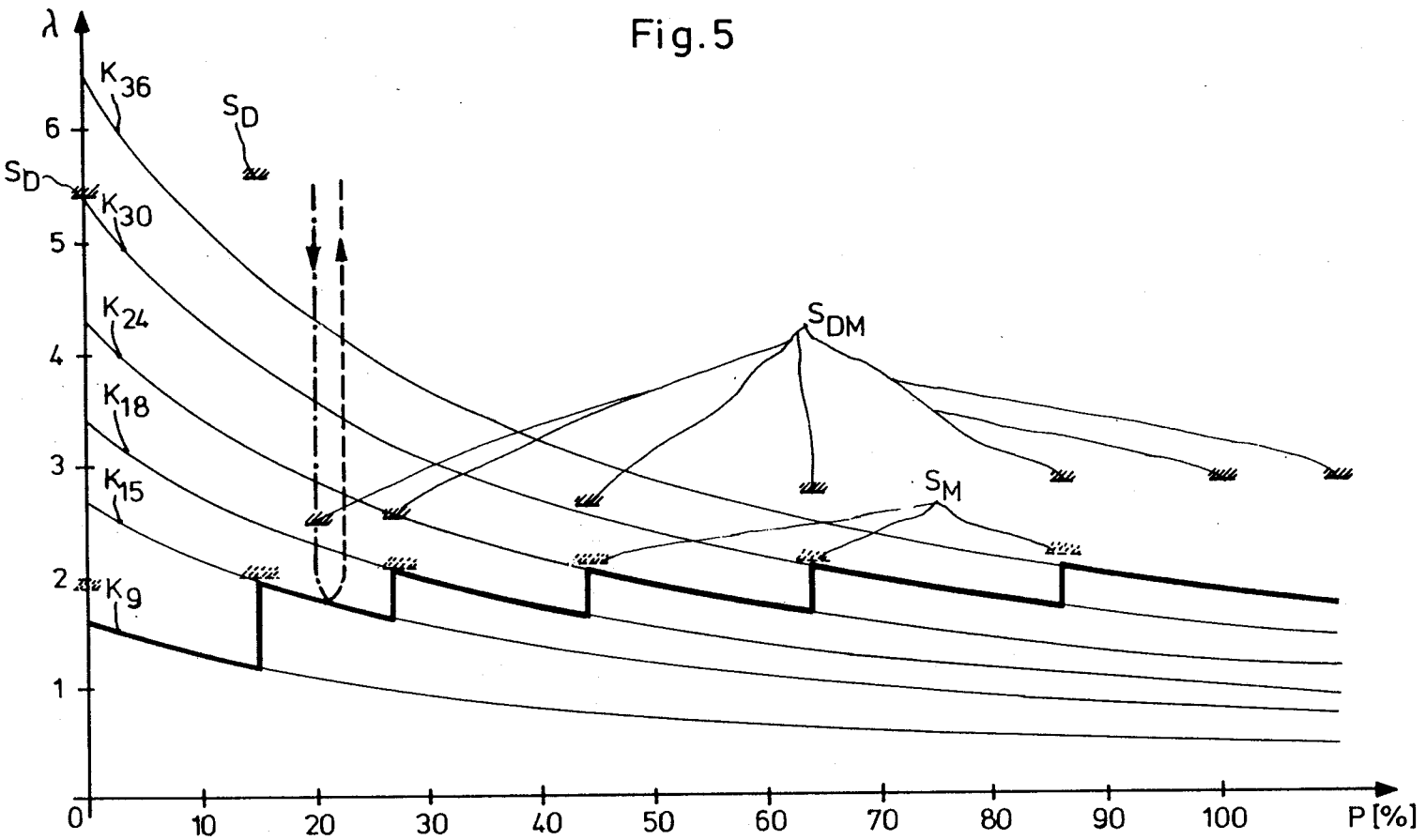
FIG. 5 shows a fuel control curve for bringing the combustion chamber onto load in oil operation.
Figure 6:
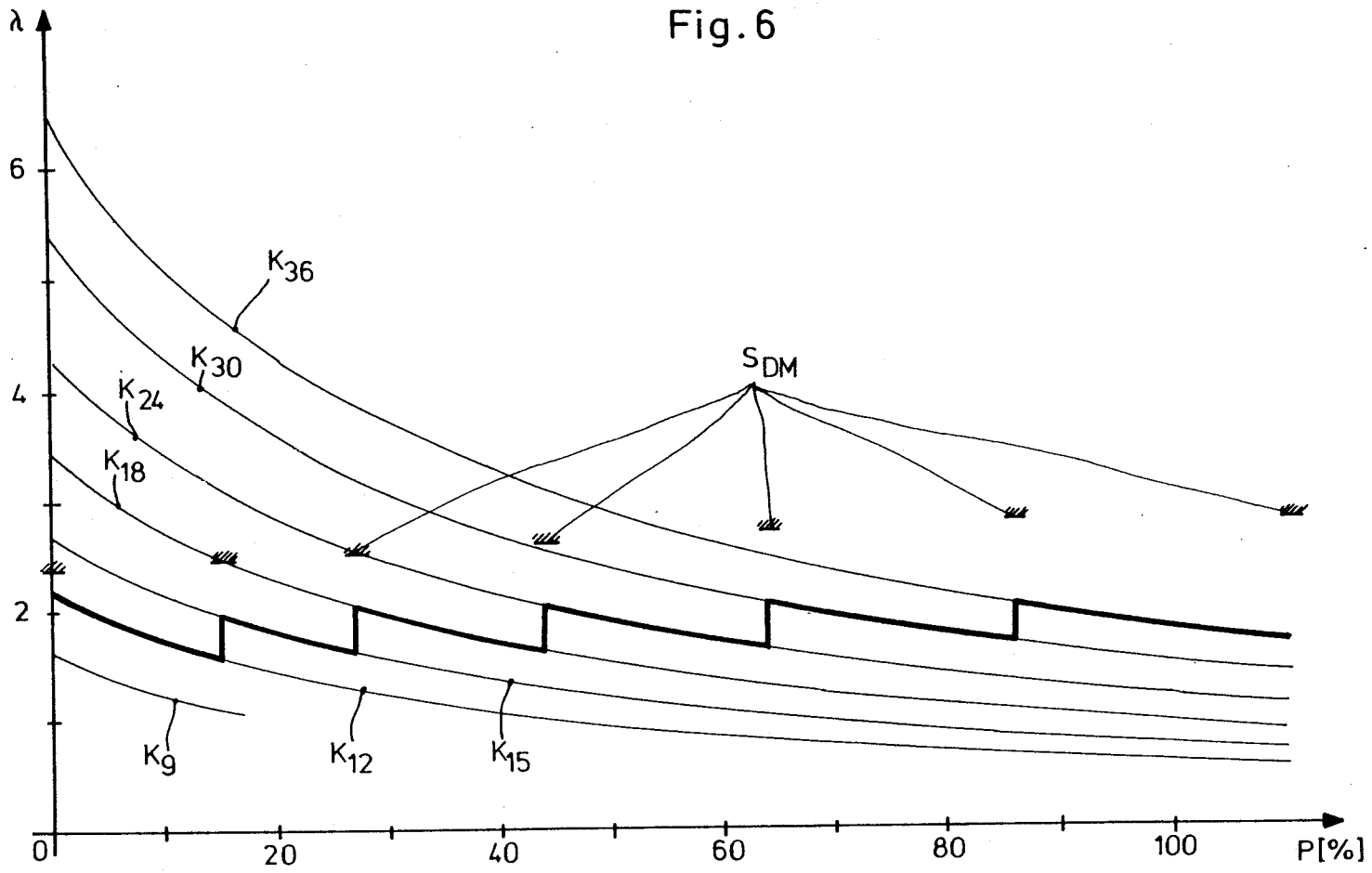
FIG. 6 shows a fuel control curve for bringing the combustion chamber onto load in gas operation.

The manner of operation of the invention is now explained using the fuel control curves in FIGS. 4 to 6. This is based on the arrangement of elements shown in FIG. 2 and the assumption made that the elements 2 can only be switched on and off in groups. In this connection, it appears desirable to first ignite the inner elements and then successively to put the outer elements into operation on fuel. For this purpose, the elements are divided into 6 groups with the following composition: u=9 elements, v=6 elements, w=3 elements, x, y and z, 6 elements each, the elements being shown as such in each case in FIG. 2.

In the switching diagram in FIG. 4, the machine rotational speed n is plotted in [%] on the abscissa and the excess air coefficient λ on the ordinate. The parameters $K_{24}$, $K_{18}$, $K_{15}$, $K_{12}$, $K_9$ and $K_6$ stand for a number of 24, 18 .... 6 elements in each case. The matter considered is the optimum switching curve when running up the combustion chamber in oil r operation. It is obvious that premixed combustion cannot be carried out in this case because during running up, the air from the compressor is still too cold to effect oil evaporation within the element 2. The starting procedure and the low load range are therefore carried out using pure diffusion combustion. Since an excess air coefficient of at least 1 is necessary for combustion, it is apparent from the diagram that at least 18 elements are necessary for running up.

The actual switching curve is drawn with thick lines. After the initial ignition using the centrally located burner 5, the combustion chamber is run up at 20% machine rotational speed using 18 elements. For this purpose, the groups u, v and w are in operation. In order to operate with approximately constant excess air, the group w is switched off at 60% rotational speed. This means that the same fuel quantity is now burnt in only 15 elements, which reduces the excess air coefficient. With further running up, the group v is switched off at approximately 92% rotational speed, which produces a reduction of the excess air coefficient to the value of 1.2. The fact that the curves in this region are not continuous is due to the fact that the usual blowing off of compressor air is here interrupted. In this phase, correspondingly more air is supplied to each element, resulting in a steeper rise of the curves up to the nominal rotational speed. There is no necessity for accurate reproduction of the shape of the curves in this region because it does not contribute to better understanding of the invention. The only important point is that there is an excess air coefficient of approximately 1.6 at idling.

The loading procedure from idling is explained in FIG. 5. In this diagram, the load P in [%] is plotted on the abscissa and the excess air coefficient λ again on the ordinate, but at a different scale. The parameters are the same as in FIG. 4. In addition, the stability limits for pure diffusion combustion, pure premixed combustion and simultaneous diffusion and premixed combustion, as the latter occurs according to the invention, are plotted as $S_D$, $S_M$ and $S_{DM}$.

It may be seen that the stability limit $S_D$ for pure diffusion operation occurs at very high excess air coefficient. However, with such a method of running, the required $NO_x$ of less than 75 ppm cannot be obtained. The figure which can be given as a guide is that diffusion combustion alone results in approximately 180 ppm $NO_x$ emissions.

On the other hand, it is possible to keep within the $NO_x$ limiting value without difficulty using pure premixed combustion but the stability boundary $S_M$ is then low because of the low flame temperature. The range between ignition capability and extinguishing is then too small to enable safe running of the gas turbine in the full load range.

The invention is therefore based on a mixed method of running with diffusion and premixed combustion in the load range. The proportional oil quantity ratio is then so chosen in each case that a method of running is possible with a sufficiently large margin from the resulting stability boundary $S_{DM}$. The result of tests is that this is best attained if 90 to 95% of the fuel is fired according to the premixed principle and 5 to 10% of the fuel according to the diffusion principle.

A mixed method of running with 10% diffusion proportion is shown in the diagram. From idling up to 15% load, running is carried out with one quarter of the available element, i.e. with only the group u in pure diffusion operation. With the increase in the fuel oil supply, λ has become so small at 15% load that the group of elements v must be switched on again. At 20% load, the premixing system is then put into operation for all the elements of each of the groups u and v, which leads to a distribution of the fuel oil in the ratio quoted above. The reduction of the fuel at the diffusion nozzles at a constant air quantity produces a sharp rise in the excess air coefficient, as is shown by the interrupted line. On the other hand, putting the premixing into operation by a reduction of the excess air coefficient from the value ∞ (infinity) to the value shown at 20% load can be represented as shown chain dotted. By means of this measure, the stability boundary also falls to the value $S_{DM}$ shown at 20% load.

The further control curve with increase of load is now so fixed that the excess air coefficient moves continually between 1.5 and 2. For this purpose, in the example shown, the groups of elements w, x, y and z are switched on in the order quoted at loads of P=27%, 44%, 64% and 86%, respectively.

The diagram in FIG. 6 deals with the optimum fuel control curve in the load range with gas combustion. All the quantities shown from 20% load correspond to those in FIG. 5. The gas operation differs from the oil operation only in the starting phase and the lower load range. The starting procedure from 20% machine rotational speed up to idling (not shown) already takes place with mixed diffusion/premixed combustion and it has, in fact, been found advantageous if the operation is run with 50% premix and 50% diffusion combustion in each case. This is possible because evaporation and the air temperature required for it are not necessary. It is, of course, also possible to run with, for example, 30% diffusion and 70% premixing or any other intermediate value.

FIG. 6 shows, however, in deviation from FIG. 5, that the take-up of load can be carried out with 12 elements, i.e. with the groups u and, for example, w. This is due to the fact that in the low load range, i.e. between 0 and 15% load, the excess air coefficient cannot be reduced so much as in pure diffusion operation. In fact, the flame with premixed combustion is so hot at low excess air coefficient that the flameholder could be damaged. The same quantity of fuel is therefore better distributed between additional elements, by which means a higher value of λ is in fact obtained but, in the short term, a higher CO emission must also be accepted.

As in the case of oil operation, a further 3 elements are also switched on in this case at 15% load. This can, for example, be undertaken by simultaneously switching off the group w and switching on the group v.

We claim:

1. A combustion compartment for a gas turbine comprising:

(a) a combustion chamber shell having a combustion space and an air distribution chamber within said shell, said combustion space being spaced from said air distribution chamber, and including a supporting bridge extending across said shell and forming a boundary wall of said air distribution chamber;

(b) a tubular ignition burner at the center of said shell, and a plurality of tubular elements in said shell surrounding said ignition burner, said tubular elements and said ignition burner extending between said supporting bridge and said combustion space; said bridge and said ignition burner and said tubular elements cooperating to prevent the flow of fluid between said air distribution space and said combustion chamber except through said burner and said elements;

(c) each of said tubular elements having a flame holder in said combustion chamber;

(d) fuel supply means extending through each of said tubular elements and terminating adjacent said flame holder; and (e) air supply means extending through each of said tubular elements independently of said fuel supply means and communicating between said air distribution chamber and said combustion space.

2. The combustion compartment according to claim 1 wherein said fuel supply means includes a central pipe in each of said tubular elements and said air supply means includes an air passage surrounding said central pipe and communicating with the interior of said pipe adjacent said combustion space.

3. The combustion compartment according to claim 2 wherein said fuel supply means includes a swirl chamber in said central pipe adjacent said combustion space and said air passage communicating with said swirl chamber.

4. The combustion compartment according to claim 1 wherein said tubular elements have a central pipe extending from said air distribution chamber to said combustion space, an annular fuel supply line surrounding said central pipe, said annular fuel supply line including a fuel nozzle positioned for directing fuel outwardly relative to said central pipe, said fuel nozzle being positioned substantially equally spaced from said air distribution chamber and said combustion space, whereby fuel from said nozzle flows into the air stream which passes through said tubular elements.

5. The combustion compartment according to claim 4 including an additional gas chamber surrounding said central pipe, said gas chamber including a nozzle for conducting gas outwardly into said air passage, said gas chamber nozzle being spaced from said combustion space.

6. The combustion compartment according to claim 5 including an annular air chamber surrounding said central pipe and extending from said air distribution chamber to said swirl chamber, said annular fuel supply line communicating with said annular air chamber at a location spaced between said swirl chamber and said air distribution chamber.

* * * * *